US005642768A

United States Patent [19]

Shiels et al.

[11] Patent Number: 5,642,768

[45] Date of Patent: Jul. 1, 1997

[54] APPARATUS FOR MELTING AND POURING METAL AND METAL ALLOYS

[76] Inventors: Paul Shiels, 2717 Moriningside, NE., Albuquerque, N. Mex. 87110; Louis E. Bell, 3302 La Rambla, NW., Albuquerque, N. Mex. 87120; Martin Gaigl, 3400 Alvardo, NE., Albuquerque, N. Mex. 87110

[21] Appl. No.: 538,438

[22] Filed: Oct. 3, 1995

[51] Int. Cl.[6] ..... B22D 41/00; B22D 27/02

[52] U.S. Cl. ..... 164/335; 164/337; 164/513

[58] Field of Search ..... 164/335, 337, 164/133–135, 513, 514, 493, 495

[56] References Cited

U.S. PATENT DOCUMENTS 4,630,666 12/1986 Wismann ..... 164/335
4,986,941 1/1991 Hendrix et al. ..... 264/13

FOREIGN PATENT DOCUMENTS 1360891 12/1987 U.S.S.R. ..... 164/133

OTHER PUBLICATIONS

A. S. Gallee and D. H. Baldwin, "A Device for Fabricating Metal Matrix Composites by Liquid Infiltration Under a Protective Atmosphere", in *Composites* (May 1975) vol. 6, No. 3.

*Primary Examiner*—Joseph J. Hail, III
*Assistant Examiner*—I.-H. Lin
*Attorney, Agent, or Firm*—Samuel M. Freund

[57] ABSTRACT

Apparatus for heating and pouring metal and metal alloys. A metal melting and pouring apparatus suitable for graining the molten material is described. A graphite crucible having at least one exit orifice in its lower, tapered portion, a graphite barrier plate or disk having a plurality of orifices located within the crucible on the tapered portion thereof, and an element for heating the apparatus to temperatures sufficient to melt the metal, have been found to produce a steady stream of consistent droplet-size molten metal, while maintaining a choosen level of liquid metal in the crucible to prevent less dense impurity materials from passing through the exit orifice(s) of the crucible, and to improve the efficiency of melting additional metal subsequently introduced into the crucible.

10 Claims, 2 Drawing Sheets

APPARATUS FOR MELTING AND POURING METAL AND METAL ALLOYS

BACKGROUND OF THE INVENTION

The present invention relates generally to crucibles for melting and pouring metals and, more particularly, to a crucible for delivering molten metal in a steady stream without clogging the exit orifice thereof.

In order to facilitate measurement, handling, pouring, and rapid and uniform melting, metal that is to be melted for molding purposes such as for jewelry, dental crowns, sheeting, etc., is generally formed into uniform grains or granules.

In the process of graining, or generating small particles of a metal from the liquid metal, the metal is commonly melted in a crucible having an exit orifice located in the bottom portion thereof. Solid metal is introduced into the crucible through its open upper portion, and melted by heating the crucible. To obtain uniform grain size of the particles exiting the crucible orifice, the temperature of the metal and the pressure head of the liquid above the orifice must both be substantially maintained at chosen values. Crucibles currently used for this purpose simply have holes in the lower portion thereof which essentially permit liquid flow as soon as liquid metal is formed in the crucible above the orifices.

One manner in which uniform grain size may be achieved is described in U.S. Pat. No. 4,986,941 for "Shotting Apparatus and Process," which issued on Jan. 22, 1991 to Loren E. Hendrix and Alan B. Mistrater. The inventors disclose a shotting apparatus which comprises a chamber for containing a molten material and a plate with a plurality of orifices through which the molten material can pass to form droplets. A head of molten metal is achieved by regulating the flow of molten material to the chamber through an entrance in its upper portion. It appears that the apparatus is heated by the molten metal introduced thereto.

Additionally, since the solid metal added to a crucible is often impure, the impurities generally having lower density than the metal itself, it is necessary to prevent materials in the proximity of the surface of the molten metal from exiting through the orifice, both to reduce the tendency of the orifice from becoming clogged, and to prevent the formation of grains which are substantially different in composition from the desired metal. It is assumed that Hendrix et al., supra, have solved this problem with some sort of metal purification before the liquid metal is introduced into the apparatus.

Accordingly, it is an object of the present invention to provide an apparatus for generating uniform droplets of molten metal for graining purposes.

Another object of the invention is to provide an apparatus for generating uniform droplets of molten metal which have uniform composition for graining purposes.

Yet another object of the invention is to provide an apparatus for efficiently melting and pouring metals.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the metal melting and dispensing apparatus of hereof may include: a crucible for containing the metal having a generally cylindrical interior with an opening to the outside at its upper end suitable for introducing the metal, and a tapered portion at its lower end opening, through at least one orifice, to the outside; a cylindrical disk having at least one hole therethrough having a chosen diameter and adapted to contact the tapered portion of the interior of the crucible in such a manner that the metal, in its molten state, cannot pass through the at least one orifice of the crucible without having passed through the at least one hole of the disk, and such that the disk is not substantially heated by the crucible; and means for heating the crucible, whereby the diameter of the at least one hole in the disk is selected such that no metal in its molten state is dispensed through the at least one orifice in the crucible unless a chosen level of the metal in its molten state is maintained in the cylindrical interior of the crucible above the disk.

It is preferred that the crucible and disk are fabricated from graphite.

In another aspect of the present invention and in accordance with its objects and purposes, the apparatus for melting and pouring metal and metal alloys hereof may include in combination: a crucible for containing the metal having a generally cylindrical inferior with an opening to the outside of the crucible at the upper end thereof suitable for introducing the metal, and a tapered portion at the lower end thereof opening, through at least one orifice, to the outside, the tapered portion of the crucible further having a circular depression formed therein; a generally circular barrier which includes two circular raised portions, each adapted to be received by the circular depression in the crucible, separated by a circular tapered portion, each circular portion having a common axis, the barrier further having at least one hole therethrough having a chosen diameter, wherein the tapered portion of the barrier is adapted to contact the tapered portion of the interior of the crucible, when one raised portion of the barrier is located in the circular depression of the crucible, in such a manner that the metal, in its molten state, cannot pass through the at least one orifice of the crucible without having passed through the at least one hole of the barrier, and such that the barrier is not substantially heated by the crucible; and means for heating the crucible, whereby the diameter of the at least one hole in the barrier is selected such that no metal in its molten state is dispensed through the at least one orifice in the crucible unless a chosen level of the metal in its molten state is maintained in the cylindrical interior of the crucible on the side of the barrier located away from the at least one orifice in the crucible.

Preferably, the crucible and barrier are fabricated from graphite.

Benefits and advantages of the present invention include rapid, energy-efficient melting of metallic pieces, separation of lower-density impurities, and uniform droplet (grain) size generation.

BRIEF DESCRIPTION OF THE DRAWINGS

The accompanying drawings, which are incorporated in and form a part of the specification, illustrate two embodiments of the present invention and, together with the description, serve to explain the principles of the invention.

DETAILED DESCRIPTION OF THE INVENTION

Briefly, the present invention includes a metal melting and pouring apparatus comprising a crucible having at least one exit orifice in its lower, tapered portion, a barrier plate or cylindrical disk having a plurality of orifices located within the crucible on the tapered portion thereof, and means for heating the apparatus to temperatures sufficient to melt the metal, for generating a steady stream of consistent droplet-size molten metal, while maintaining a choose level of liquid metal in the crucible to prevent less dense impurity materials from passing through the exit orifice(s) of the crucible and improving the efficiency for melting of additional metal subsequently introduced into the crucible.

Figure 1:
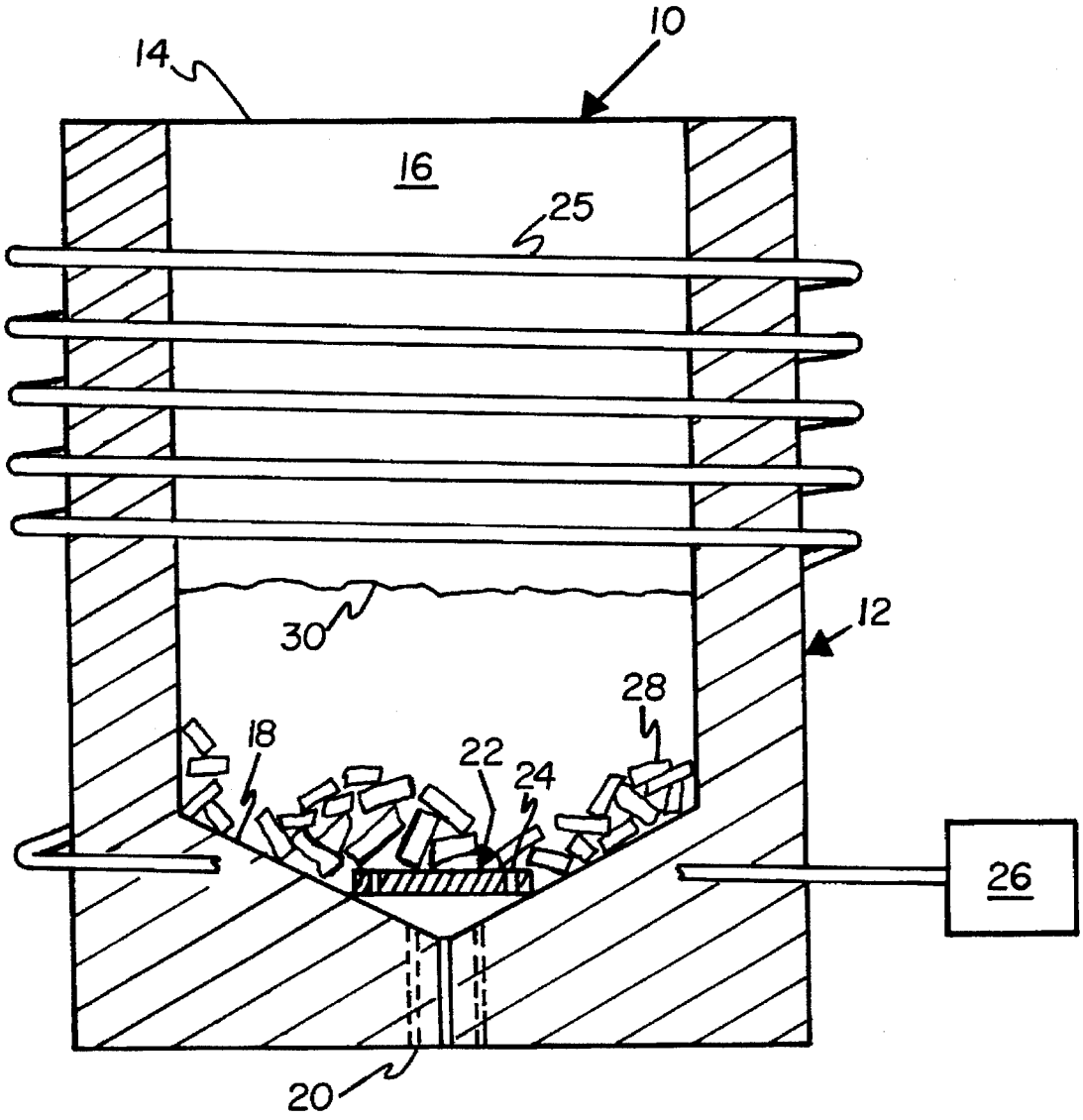
FIG. 1 is a schematic representation of the side view of the apparatus of the present invention illustrating the crucible and disk thereof, and an rf coil heating element.
Figure 2:
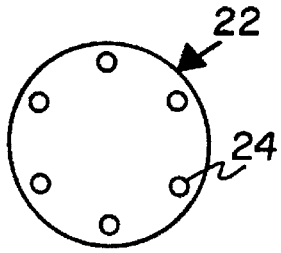
FIG. 2 is a schematic illustration of the top view of the disk.
Figure 3:
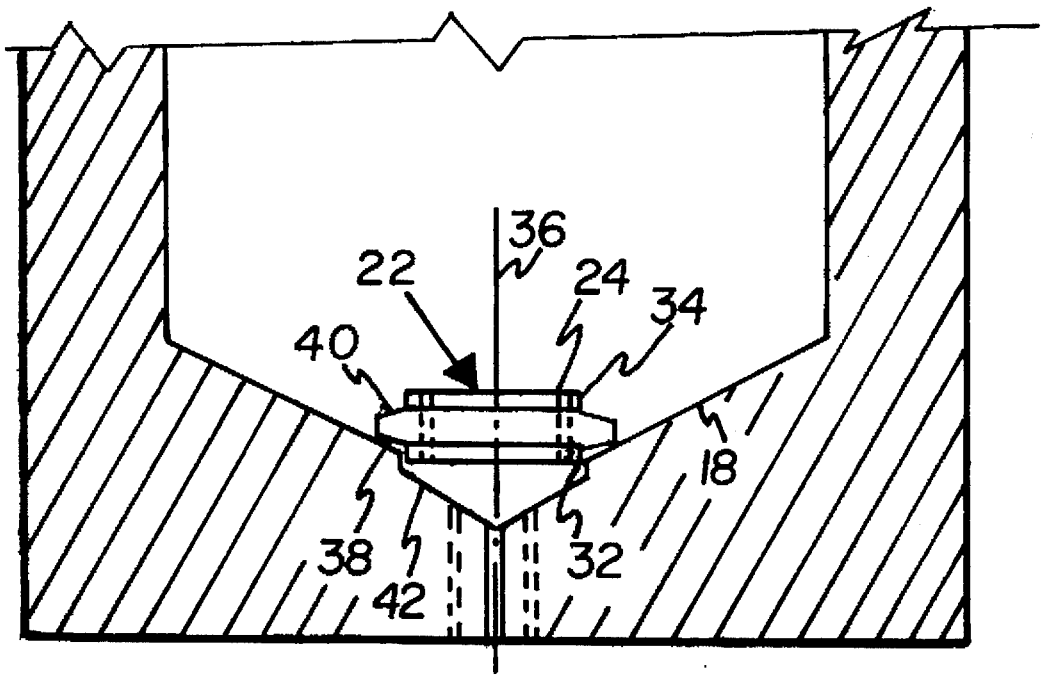
FIG. 3 is a schematic representation of the side view of a second embodiment of the present invention, illustrating the location of the barrier thereof in an indentation formed in the crucible.

Reference will now be made in detail to the present preferred embodiments of the invention, examples of which are illustrated in the accompanying drawings. FIG. 1 is a schematic representation of the side view of one embodiment of the present invention, 10, and shows crucible, 12, thereof having top opening, 14, metal-holding portion, 16, tapered portion, 18, and exit orifice, 20. Cylindrical barrier plate or disk, 22, is disposed on tapered portion, 18, of the crucible and has exit orifices, 24. Heating means 25 and 26, supplies heat to crucible, 12, and may be radio-frequency (rf) or thermal element heating. Shown is rf or thermal coil, 25, surrounding crucible, 12, controlled by controller, 26 surrounding crucible, 12. FIG. 2 is a schematic representation of the top view of disk, 22, showing exit orifices, 24.

In actual operation, metal chunks, 28, are placed in metal-holding portion, 16, and the crucible is heated by heating means, 26. As the chunks liquefy, liquid metal accumulates above disk, 22. Disk, 22, is adapted to fit snugly on tapered portion, 18, such that it is initially held in place by metal chunks 28 and liquid metal cannot bypass the disk and exit the crucible through exit orifices, 20, without first passing through disk orifices, 24. The disk is not significantly heated by contact with the walls of crucible, 12, since the only contact is made along an edge of the disk. The molten metal eventually heats the disk. Exit orifices, 24, and the thickness of disk, 22, are selected such that no liquid metal will pass through the orifices until a chosen level, 30, of liquid metal is maintained in the crucible above the disk. When this level is achieved or exceeded, liquid metal may flow through orifices, 24, and out of the crucible through exit orifices, 20. By requiring a chosen liquid level to be present before metal can exit the crucible, a controlled flow of pure metal results, generating thereby uniform grain size in the effluent from the crucible. Additional metal chunks may be added to the liquid through opening, 14, in the crucible in order to maintain the liquid flow. Heating and liquefaction thereof is efficient and rapid due to the presence of the molten metal in the crucible. Generally, impurities in the metal have lower density than the metal itself, and will float on the liquid-metal surface.

When the pouring process is to be terminated, the liquid level in the crucible is permitted to fall to the level at which no further flow through the disk orifices takes place, and disk, 22, may be simply removed by dislodging it with a rod. It will then float to the top of the molten metal and can be removed. The liquid metal may then be drained through exit orifices, 20 into a different collection receptacle than that used to receive the desired metal flow. Holes, 20, may be readily cleaned after the crucible has been emptied, since they are made larger than disk orifices, 24.

Having generally described the apparatus of the present invention, the following example will more particularly illustrate its features and method of its employment.

EXAMPLE

Disk orifice, hole size 24, is chosen depending on the density and surface tension of the metal or alloy to be liquefied and dispensed, and the chosen liquid level to be maintained. Crucible exit orifice, size 20, is chosen depending on the desired droplet size of the exiting molten metal. For example, gold at about 1060° C. may be poured at a rate of about 28 cc/min. to produce grains having 6 mm diameter from a crucible having an inner diameter of 6.5 cm, a height of 8.5 cm and five 1.85 mm diameter exit orifices, and a 2.5 cm diameter disk having a thickness of 6 mm with six exit holes each having a diameter of 1.2 mm. The liquid level maintained with these dimensions was about 4 cm from the bottom of the crucible interior. Useful disk orifices ranged from between 1.07 mm and 1.32 mm for gold, and from between 1.57 mm and 1.78 mm for silver. Crucible and disk materials were chosen to be compatible with the metal to be dispensed. For gold, both the crucible and the disk were fabricated from graphite. Clearly, other materials may be employed.

In a second embodiment of the present invention, in order to more firmly, but reversibly, locate barrier plate, 22, in the tapered portion, 18, of crucible, 12, during the metal loading process, thereby reducing the possibility that barrier, 22, be dislodged, barrier, 22, is provided with circular-shaped raised portions, 32 and 34, centered along centerline, 36, thereof and tapered portions, 38 and 40. Tapered portions, 38 and 40, are adapted to tapered portion, 18, of crucible, 12, such that the edge of tapered portion 38 or 40, rests on tapered portion, 18, when one circular-shaped raised portion, either 32 or 34, of barrier, 22, is located in depression, 42, which is formed in the lower portion of taper, 18, of crucible, 12, to so accommodate the circular raised portions of barrier, 22. Two raised portions and tapers are provided for each barrier to permit an additional surface to be used when one surface wears significantly.

The foregoing description of two preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for melting and pouring metal and metal alloys which comprises in combination: a crucible for containing the metal having a generally cylindrical inferior with an opening to the outside of said crucible at the upper end thereof suitable for introducing the metal into said crucible, and a tapered portion at the lower end thereof opening, through at least one orifice, to the outside of said crucible; a cylindrical disk having at least one hole therethrough having a chosen diameter and adapted to contact the tapered portion of the interior of said crucible in such a manner that the metal, in its molten state, cannot pass through the at least one orifice of said crucible without having passed through the at least one hole of said disk, and such that said disk is not substantially heated by said crucible; and means for heating said crucible, whereby the diameter of the at least one hole in said cylindrical disk is selected such that no metal in its molten state is dispensed through the at least one orifice in said crucible unless a chosen level of the metal in its molten state is maintained in the cylindrical interior of said crucible on the side of said disk located away from the at least one orifice in said crucible.

2. The apparatus for melting and pouring metal and metal alloys as described in claim 1, wherein said crucible is fabricated from graphite.

3. The apparatus for melting and pouring metal and metal alloys as described in claim 1, wherein said disk is fabricated from graphite.

4. The apparatus for melting and pouring metal and metal alloys as described in claim 1, wherein said means for heating said crucible includes thermal heating means.

5. The apparatus for melting and pouring metal and metal alloys as described in claim 1, wherein said means for heating said crucible includes radio frequency heating means.

6. An apparatus for melting and pouring metal and metal alloys which comprises in combination: a crucible for containing the metal having a generally cylindrical interior with an opening to the outside of said crucible at the upper end thereof suitable for introducing the metal into said crucible, and a tapered portion at the lower end thereof opening, through at least one orifice, to the outside of said crucible, the tapered portion of said crucible further having a circular depression formed therein; a generally circular barrier which includes two circular raised portions, each adapted to be received by the circular depression in said crucible, separated by a circular tapered portion, each circular portion having a common axis, said barrier further having at least one hole therethrough having a chosen diameter, wherein the tapered portion of said barrier is adapted to contact the tapered portion of the interior of said crucible, when one raised portion of said barrier is located in the circular depression of said crucible, in such a manner that the metal, in its molten state, cannot pass through the at least one orifice of said crucible without having passed through the at least one hole of said barrier, and such that said barrier is not substantially heated by said crucible; and means for heating said crucible, whereby the diameter of the at least one hole in said barrier is selected such that no metal in its molten state is dispensed through the at least one orifice in said crucible unless a chosen level of the metal in its molten state is maintained in the cylindrical interior of said crucible on the side of said barrier located away from the at least one orifice in said crucible.

7. The apparatus for melting and pouring metal and metal alloys as described in claim 6, wherein said crucible is fabricated from graphite.

8. The apparatus for melting and pouring metal and metal alloys as described in claim 6, wherein said barrier is fabricated from graphite.

9. The apparatus for melting and pouring metal and metal alloys as described in claim 6, wherein said means for heating said crucible includes thermal heating means.

10. The apparatus for melting and pouring metal and metal alloys as described in claim 6, wherein said means for heating said crucible includes radio frequency heating means.

* * * * *